US005123645A

United States Patent [19]

MacDonald et al.

[11] Patent Number: 5,123,645

[45] Date of Patent: Jun. 23, 1992

[54] PROJECTILE WITH INTERIORLY WEIGHTED FLOW PASSAGE INSERT

[76] Inventors: Richard A. MacDonald, 504 Baywood Dr.; James A. MacDonald, 4052 Bayshore Rd., both of Cape May, N.J. 08204

[21] Appl. No.: 671,043

[22] Filed: Mar. 18, 1991

[51] Int. Cl.[5] ..... A63B 41/00

[52] U.S. Cl. ..... 273/65 EC; 273/DIG. 20

[58] Field of Search ..... 273/65 EC, 65 ED, 65 EE, 273/65 EF, 65 EG, DIG. 20, 58 F, 58 B, 58 E, 58 G

[56] References Cited

U.S. PATENT DOCUMENTS 4,003,574 1/1977 MacDonald et al. ..... 273/65 EC

*Primary Examiner*—George J. Marlo

*Attorney, Agent, or Firm*—Epstein, Edell & Retzer

[57] ABSTRACT

A football-like projectile having a central longitudinal bore includes a weighted insert in the bore to concentrate the weight of the projectile interiorly of the ball about the longitudinal axis. The insert is provided with a longitudinal flow passage to permit air flow hrough the insert and the bore when the ball is in flight.

19 Claims, 1 Drawing Sheet

PROJECTILE WITH INTERIORLY WEIGHTED FLOW PASSAGE INSERT

BACKGROUND OF THE INVENTION

1. Field of the Invention

The present invention relates broadly to projectiles suitable for throwing and, in particular, to a football-like projectile. More specifically, the present invention relates to a football-like projectile having increased rotational stability and a relatively long flight path when thrown through the air.

2. Discussion of the Prior Art

The accuracy and distance for a hand-thrown projectile are difficult to predict in that they are dependent upon the control exerted on the projectile by the hand of an individual throwing or hurling it through the air. A football-like projectile, having a longitudinal or major axis longer than its lateral or minor axis, is particularly difficult to control and must be perfectly thrown with rotation or spin about its longitudinal axis in order to obtain maximum distance and precision in reaching its target. The physical coordination required in accurately throwing a football significantly limits the number of people able to master the football passing technique.

Prior art efforts toward enhancing positional and rotational stability for a thrown projectile have involved channeling air through a central constriction in a longitudinal passage formed in the body of the projectile so that the projectile adjusts itself when thrown to rotate about its longitudinal axis. Our prior U.S. Pat. No. 3,884,466, for example, discloses a football having a Venturi-like passage formed therein extending along the longitudinal axis of the ball. When the ball is thrown, air is channeled through a constricted Venturi opening located midway along the length of the passage to cause the ball to orient its major or longitudinal axis along the direction of flight. Rotation of the ball, induced by spinning it as it is thrown, minimizes air resistance and permits the ball to be thrown greater distances with improved accuracy. Rotational momentum and stability for the ball is obtained by a cylindrical band of metal imbedded in the ball periphery in alignment with the minor or transverse axis. Our U.S. Pat. No. 4,003,574 is directed to a football having an interior longitudinal Venturi-like nozzle passage and a plurality of weighted elements located within or adjacent an outer wall of the ball to provide rotational stability for the ball. In our U.S. Pat. No. 5,000,451 we disclose a football that is stabilized in flight by weighted material that responds to spinning of the football about its major axis by moving radially outward to become evenly distributed about the axis. Two annular tubes, concentrically disposed about the major axis, encircle the ball at opposite sides of a plane containing the minor axis of the ball. The weighted material, in the form of beads, liquid, etc., is contained within the tubes and is flung radially outward as the ball spins to impart improved stability.

Another ball having a longitudinal Venturi-like nozzle is disclosed in U.S. Pat. No. 4,339,138 (DiManno) and is characterized by the nozzle forming frusto-conical members extending longitudinally beyond opposite ends of the ball.

The above-described football-like devices all provide for airflow longitudinally through the ball to establish proper orientation of the longitudinal axis. To the extent that weighting is used to improve rotational stability, weighted elements are placed at the ball periphery We have found, however, that peripheral weighting is not necessarily the most efficient or effective technique for achieving rotational stability of a thrown football-like projectile.

SUMMARY OF THE INVENTION

Accordingly, it is an object of the present invention to construct a projectile capable of being thrown significantly long distances with great accuracy.

It is another object of the present invention to provide a projectile with improved means for stabilizing rotation of the projectile about its longitudinal axis.

Another object of the present invention is to construct a projectile with flight stabilizing means causing the projectile, when thrown, to rotate in a true spiral.

A further object of the present invention is to provide a football of the general type described but stabilized by weight mounted interiorly of the ball symmetrically about its longitudinal axis.

An additional object of the present invention is to provide a football with an interior flow channel defined, at least in part, by weighted means and disposed symmetrically with respect to both the longitudinal and transverse axes of the football.

Further, it is an object of the present invention to provide a football-shaped projectile of the type described that is capable of being easily and inexpensively manufactured.

These and other objects and attributes are achieved with the projectile of the present invention defined by a body symmetrical about a major or longitudinal axis and characterized by a weighted hollow cylinder or Venturi tube, symmetrical both to the major axis and to the minor axis. The cylinder or Venturi tube provides both the air flow passage for imparting orientation stability and the weighting necessary to enhance rotational stability in flight.

BRIEF DESCRIPTION OF THE DRAWINGS

The above and still further objects, features and advantages of the present invention will become apparent upon consideration of the following detailed description of specific embodiments thereof, particularly when taken in conjunction with the accompanying drawings wherein like reference numerals in the various figures are utilized to designate like components, and wherein.

DESCRIPTION OF THE PREFERRED EMBODIMENTS

Figure 1:
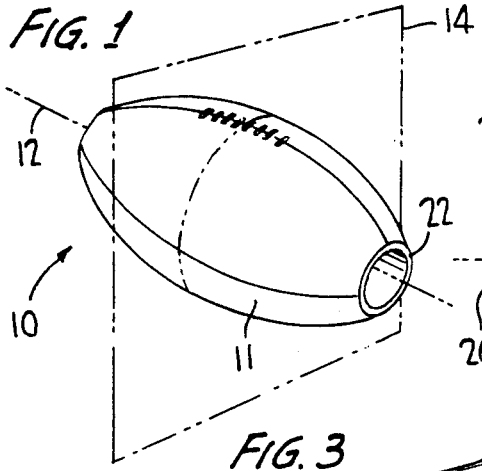
FIG. 1 is a view in perspective of a football-like projectile according to the present invention.
Figure 2:
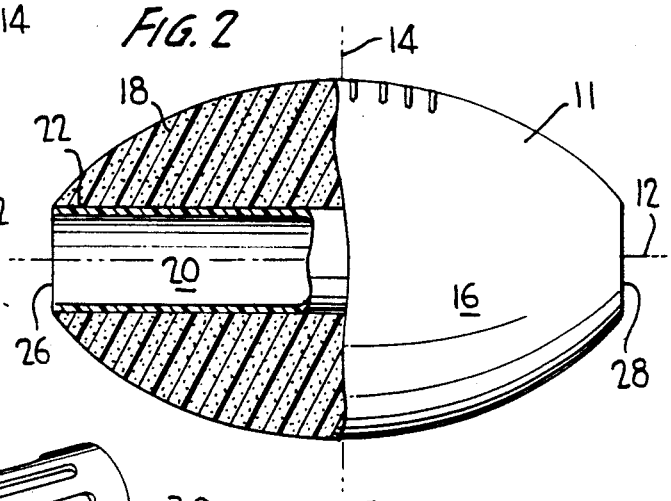
FIG. 2 is a side view in partial longitudinal section of the projectile of FIG. 1 showing a cylindrical weighted flow channel-defining insert according to the present invention.

One embodiment of the aerial projectile of the present invention is described in conjunction with a ball 10 illustrated in FIGS. 1 and 2. Ball 10 includes a body 11 having a prolate spheroid configuration, such as that for a football, with a central longitudinal or major axis 12 and a lateral plane 14 containing a minor axis and disposed transverse to and bisecting the longitudinal axis. Longitudinal axis 12 is longer than a lateral axis in plane 14 and defines an axis of rotation for ball 10 when it is manually thrown spinning through the air by the hand of the user or player.

Body 11 includes a lightweight, pliable and easily molded outer casing 16. Preferably, casing 16 is fabricated from a lightweight, low density plastic material coated with or formed of a low coefficient of friction material to reduce air drag when the ball 10 is thrown through the air. A lightweight resiliently compressible material 18 having low density, such as a foam or sponge rubber, fills casing 16. Ball 10 is thus easily manipulable by a wide variety of users to provide ease of handling by persons of virtually all ages and physical strengths.

An air passage 20 defined by a weighted hollow cylindrical insert 22 extends longitudinally in a through bore within body 10 from an opening 26 in one end of the body to an opening 28 in the opposite end of the body. The through bore and insert 22 are longitudinally centered in the ball and coaxial about the longitudinal axis 12 of the body and are symmetrical about lateral plane 14. In order to hold insert 22 in place in the through bore, a suitable adhesive may be placed between the outer surface of the insert and the inner surface of the bore in body 10. Alternatively, and in any event, the bore has a smaller diameter than the insert which outwardly compresses the foam material 18 in frictional engagement. Insert 22 is made of a considerably denser material than the lightweight material 18 of body 10. For example, insert 22 is typically a rigid polyvinylchloride (PVC), or the like, pipe section Accordingly, a significant part of the weight of the ball is concentrated interiorly of the ball at insert 22.

In a typical ball 10 according to the invention, the width of the ball, as measured by the outermost diameter coincident with the transverse plane 14, is approximately seventy percent of the length of the ball as measured from bore opening 26 to bore opening 28 along longitudinal axis 12. The inner diameter of insert 22 is typically between twenty and forty-five percent of the width of the ball. The weight of insert 22 is preferably between ten and sixty-five percent of the entire ball 10.

An embodiment of ball 10 that has been successfully tested has a length of eight inches, a width of 5.6 inches, a polyvinylchloride insert 22 with a two inch inside diameter and 3/16 inch wall thickness weighing 4.75 ounces, and a total ball weight (including the insert) of 8.3 ounces. These specific dimensions constitute only one example of a workable embodiment of the present invention and should not be construed as limiting the scope of the invention. In any case, the ball is sized and configured to be held in the hand of a user in the manner of a football.

Figure 3:
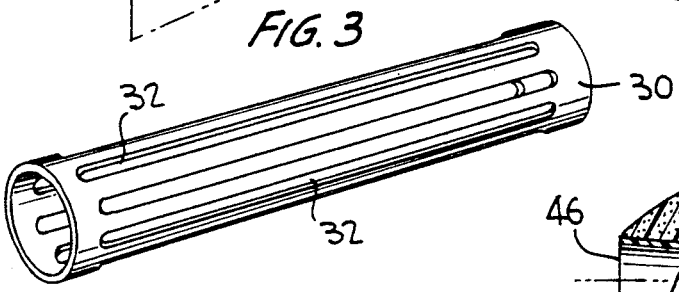
FIG. 3 is a view in perspective of a modified form of the cylindrical weighted flow channel-defining insert according to the present invention.

Referring to FIG. 3 of the accompanying drawings, a modified insert 30 to replace insert 22 shown in FIG. 2, is also cylindrical but has multiple apertures, in the form of elongated slots 32, defined through its wall. The removal of insert material to form slots 32 reduces the overall weight of the insert as desired for any particular embodiment. It should be noted, however, that this is only one of the many ways in which the weight of an insert can be reduced to the desired weight for a particular ball. For example, the apertures may be a series of holes that are round or have any other desired configuration, it being preferred that the apertures be symmetrically positioned on opposite sides of lateral plane 14 so that the weight of the insert is substantially equal on both sides of that plane. Alternatively, the appropriate weight of the insert can be selected by choosing an appropriate wall thickness for the insert, or shortening the insert length.

Figure 4:
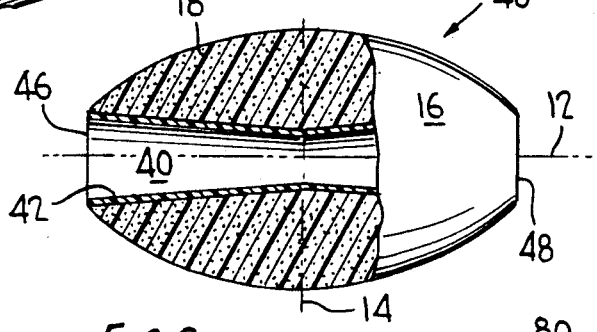
FIG. 4 is a view in longitudinal section of a projectile according to the present invention having a Venturi-type weighted flow channel-defining insert.

The embodiment illustrated in FIG. 4 differs from the embodiment illustrated in FIGS. 1 and 2 in that the longitudinal bore and insert are in the form of a Venturi passage. Specifically, ball 40 includes a body 11, longitudinal axis 12, pliable and easily molded outer casing 16 and lightweight resiliently compressible foam material 18 surrounding a Venturi-like bore with a constriction disposed at lateral plane 14. The bore has openings 46 and 48 at its opposite ends. An insert 42 is disposed in the bore to define the flow passage 40 and may be considered as being comprised of two frusto-conical sections disposed with their small diameter ends joined at lateral plane 14, and their large diameter ends disposed coincident with bore openings 46 and 48. Insert 42, like inserts 22 and 30, is made of considerably denser material than the lightweight material 18 of body 11. Accordingly, a significant part of the weight of the ball 40 is concentrated interiorly at insert 42.

Figure 5:
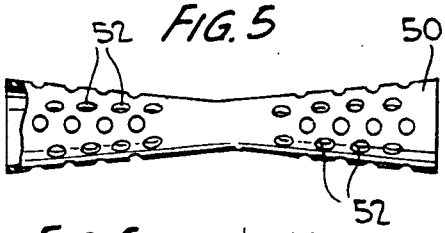
FIG. 5 is a perspective view of a modified form of the Venturi insert according to the present invention.

A modified form of the Venturi-type insert is illustrated in FIG. 5. Specifically, insert 50 has plurality of circular apertures 52 defined at various locations such that the mass of weight of the insert is substantially equal on both sides of the center point at which lateral plane 14 is disposed.

In a typical embodiment of ball 40 using a Venturi-type insert, wherein the ball body 11 has the same general dimensions described above in the exemplary embodiment for FIGS. 1 and 2, the Venturi insert 42, 50 has a range of diameters at its larger end of 1.25 to 2.5 inches, and a range of diameters at its longitudinal center of between 0.25 to 1.5 inches. The weight ranges described above for the embodiment of FIGS. 1 and 2 apply to the embodiment of FIGS. 4 and 5, as well as to other embodiments described hereinbelow.

Figure 6:
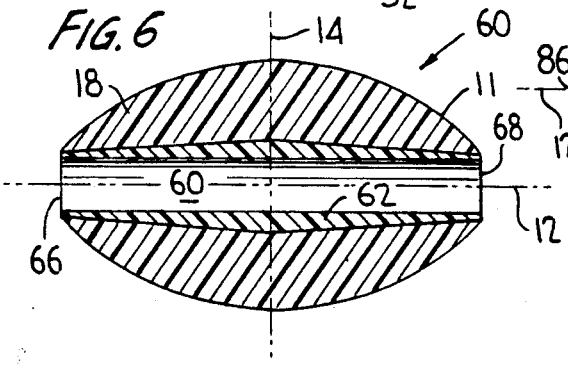
FIG. 6 is a view in longitudinal section of a projectile according to the present invention wherein a cylindrical insert has its weight concentrated more at the longitudinal center of the ball.

Referring now to FIG. 6 of the accompanying drawings, another ball embodiment 60 of the present invention includes a body 11, longitudinal axis 12, lateral plane 14, casing 16 and body material 18 of the same type described hereinabove. An insert 62 is disposed in a suitably configured longitudinally centered bore in body 11 and has a generally cylindrical interior wall defining a flow passage 60 between ends 66 and 68 of the bore. Insert 62 has a wall thickness that varies continuously so as to gradually increase from its ends to its longitudinal center, thereby concentrating most of the weight of the insert, and the ball, at lateral plane 14. The thickness of insert 62 is illustrated as varying along straight lines; however, it is understood that the thickness may vary curvilinearly, or with distinct transition points, or in substantially any manner as long as the weight is symmetrical with respect to lateral axis 14.

Figure 7:
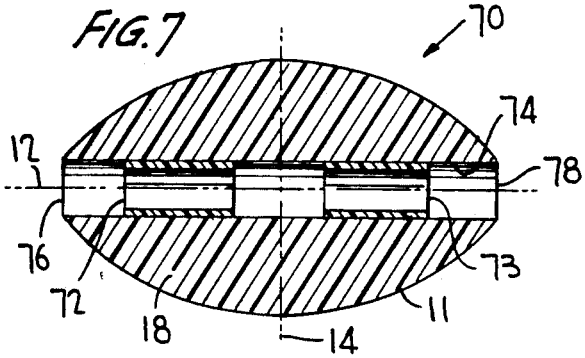
FIG. 7 is a view in longitudinal section of a projectile according to the present invention wherein the weighted insert is formed by two spaced hollow cylinders.

The embodiment illustrated in FIG. 7 illustrates the fact that the insert need not extend the entire length of the longitudinal bore defined through the ball. Specifically, ball 70 includes body 11, longitudinal axis 12, lateral plane 14, outer casing 16 and interior material 18 as described above for the other embodiments. A longitudinal bore 74 of generally cylindrical configuration is defined between ends 76 and 78. Two hollow cylindrical inserts 72, 73 are disposed within bore 74 on opposite sides and equally-distant from plane 14. Inserts 72 and 73 are merely smaller sections of hollow cylindrical pipe configured to provide the desired weight distributed symmetrically about plane 14. In this manner, inserts 72 and 73 define respective portions of the flow passage 70 extending between ends 76 and 78 of bore 74. The cylindrical configuration illustrated for bore 74 and for inserts 72 and 73 is not to be construed as a limiting feature of the invention. For example, bore 74 may be configured with a Venturi shape whereby inserts 72 and 73 would have corresponding frusto-conical configurations.

Figure 8:
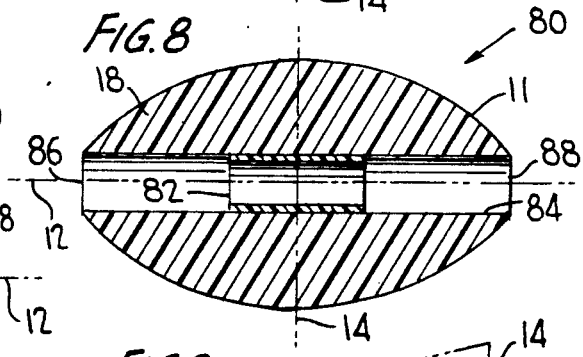
FIG. 8 is a view in longitudinal section of the projectile of the present invention with a short cylindrical weighted insert disposed in the interior flow path.

In FIG. 8 there is illustrated another ball embodiment 80 also having a body 11, longitudinal axis 12, lateral plane 14, casing 16 and interior fill material 18. Longitudinal bore 84 is generally cylindrical, although it may take other configurations in accordance with the present invention, and extends from ends 86 and 88. Insert 82 is a generally cylindrical hollow type section having a length considerably shorter than bore 84 but disposed in the bore symmetrically about lateral plane 14. Insert 82 need not be cylindrical but, instead, may have a Venturi-like throat, a variable thickness, etc., its configuration being limited only by the principles of the present invention as described herein.

Figure 9:
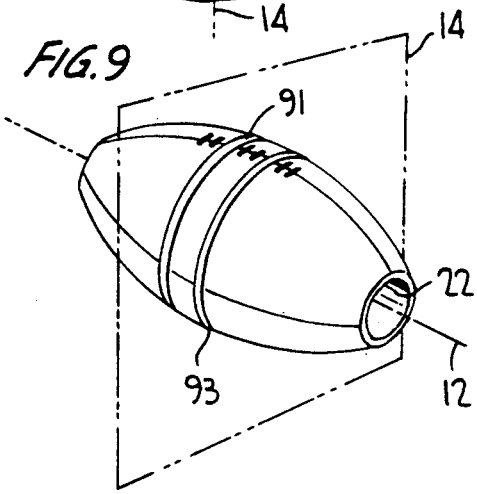
FIG. 9 is a view in perspective of a further embodiment of the projectile of the present invention.

FIG. 9 illustrates a further embodiment whereby the features of the invention described in our aforementioned U.S. Pat. No. 5,000,451 are combined with the weighted insert feature of the present invention. For a detailed description of the features of that prior invention, reference is made to U.S. Pat. No. 5,000,451, the disclosure from which is expressly incorporated herein by this reference. For present purposes it is only necessary to indicate that a pair of circumferential grooves are defined in the exterior of the ball body and disposed in respective parallel planes perpendicular to longitudinal axis 12. The grooves are also parallel to lateral plane 14 and symmetrical with respect to that plane. Hollow tubular rings 91, 93 are disposed in the grooves, and a plurality of weighted beads are contained within each of the rings 91, 93. There is diametric clearance between the beads and the surrounding interior wall of rings 91, 93 so that the beads are free to move radially within the rings. When the projectile is thrown with a spin about axis 12, the beads are automatically force radially outward and tend to space themselves equally within the rings 91, 93 against the outermost surface of the interior ring walls. As a result of the beads being forced radially outward, the projectile tends to align longitudinal axis 12 with the direction of flight while permitting a true spiral rotation about that axis. We have found that these features, combined with the interiorly weighted insert of the present invention, provide extremely good results in the form of enhanced rotational stability and axial orientation stability when the ball is in flight.

It should be understood that the concepts of the present invention are not necessarily limited to the use of foam material for the interior of the ball body. For example, the ball may be of an inflatable bladder type having an interiorly weighted member. Further, although plastic pipe, particularly PVC pipe, has been described as the preferred form of a weighted insert, it is to be understood that other materials and configurations can be used for the weighted inserted within the scope of the present invention. In addition, the insert may extend longitudinally beyond the ends of the ball in the manner disclosed in the aforementioned DiManno patent.

Having described preferred embodiments of a new and improved flight stabilized projectile constructed in accordance with the present invention, it is believed that other modifications, variations and changes will be suggested to those skilled in the art in view of the teachings set forth herein. It is therefore to be understood that all such variations, modifications and changes are believed to fall within the scope of the present invention as defined by the appended claims.

What is claimed is:

1. A projectile adapted to be thrown through the air comprising:

a body elongated in a longitudinal dimension, having first and second ends and configured substantially symmetrically about a longitudinal axis and a lateral plane oriented perpendicular to said longitudinal axis, said body having a bore extending longitudinally therethrough between said first and second ends concentrically about said longitudinal axis;

hollow weighted insert means inserted into said bore to be symmetrical about said longitudinal axis with equal mass on opposite sides of said lateral plane, said inserted means having a passage extending entirely therethrough to define a flow passage through said bore;

wherein said insert means is of a material that is substantially more dense than said body to thereby concentrate the overall weight of the projectile in said bore.

2. The projectile according to claim 1 wherein said insert means is longitudinally co-extensive with said bore.

3. The projectile according to claim 1 wherein said insert means is longitudinally shorter than said bore.

4. The projectile according to claim 1 wherein said bore is cylindrical and said insert means is a hollow cylinder.

5. The projectile according to claim 1 wherein said insert means is an elongated member having a circumferential wall with multiple apertures defined therethrough.

6. The projectile according to claim 1 wherein said insert means is an elongated member having a circumferential wall with a thickness that varies along the length of the member.

7. The projectile according to claim 1 wherein said insert means comprises a plurality of members spaced longitudinally along said bore.

8. The projectile according to claim 1 wherein said insert means has a Venturi-shaped interior surface defining said flow passage.

9. The projectile according to claim 1 further comprising movable flight stabilization means on said body at opposite sides of said lateral plane, parallel to and symmetrical about said lateral plane, said stabilization means being of sufficient weight to be flung radially outward with respect to said longitudinal axis in response to centrifugal force when said projectile is thrown through the air with spin about said longitudinal axis.

10. The projectile according to claim 9 wherein stabilization means is located within the middle one-third of the length dimension of said body and includes an enclosed chamber encircling said body and weighted means disposed within said chamber movable radially outward within said chamber with respect to said longitudinal axis, wherein said enclosed chamber is an endless tube and said weighted means is a plurality of bead-like members.

11. The projectile according to claim 1 wherein said body is a resiliently compressible material, and wherein said insert means has a lateral dimension larger than said bore so as to compress the material of said body outwardly.

12. The projectile according to claim 1 wherein said insert means is adhesively secured to said body in said bore.

13. The projectile according to claim 12 wherein said body has a generally prolate spheroid configuration.

14. The projectile according to claim 1 wherein said body is a resiliently compressible foam material and said insert member is a rigid plastic material.

15. A throwing device of hand-fitting external proportions comprising:

a body with a hollow core having a weighted member inserted therein, said weighted member having first and second hollow substantially frusto-conical segments disposed small end-to-small end to define a common throat at the central portion of the device, said central portion being substantially surrounded by said body which covers at lest part of the exterior surface of said weighted member, wherein said weighted member is a material of substantially greater density than said body to concentrate the overall weight of the device at said core.

16. The device according to claim 15 wherein said body has a generally prolate spheroid configuration.

17. The device according to claim 15 wherein said body is a resiliently compressible foam material and said weighted member is a rigid plastic member.

18. A football having improved rotational and positional stability in flight comprising:

a body having the general configuration of a football with first and second ends disposed on a longitudinal axis, and a bore defined entirely through said body between said ends and concentrically about said axis; and weighted means inserted in said bore to concentrate the weight of said football interiorly of said body symmetrically about said axis, said weighted means having a flow passage defined therethrough to permit air to flow longitudinally through the entirety of said bore and said flow passage when the football is in flight.

19. The football according to claim 18 further comprising:

movable flight stabilization means on said body and comprising an endless tube encircling said body with weighted means disposed therein, the weighted means being movable radially outwardly within said tube with respect to said axis when the football is thrown through the air so as to spin about said axis.

* * * * *